US011097291B2

(12) United States Patent
Fritz et al.

(10) Patent No.: US 11,097,291 B2
(45) Date of Patent: Aug. 24, 2021

(54) PERFORATED PLATE WITH INCREASED HOLE SPACING IN ONE OR BOTH EDGE REGIONS OF A ROW OF NOZZLES

(71) Applicant: Dürr Systems AG, Bietigheim-Bissingen (DE)

(72) Inventors: Hans-Georg Fritz, Ostfildern (DE); Benjamin Wöhr, Eibensbach (DE); Marcus Kleiner, Besigheim (DE); Moritz Bubek, Ludwigsburg (DE); Timo Beyl, Besigheim (DE)

(73) Assignee: DÜRR SYSTEMS AG, Bietigheim-Bissingen (DE)

( * ) Notice: Subject to any disclaimer, the term of this patent is extended or adjusted under 35 U.S.C. 154(b) by 142 days.

(21) Appl. No.: 16/069,907

(22) PCT Filed: Jan. 13, 2017

(86) PCT No.: PCT/EP2017/000038
§ 371 (c)(1),
(2) Date: Jul. 13, 2018

(87) PCT Pub. No.: WO2017/121644
PCT Pub. Date: Jul. 20, 2017

(65) Prior Publication Data

US 2019/0022672 A1 Jan. 24, 2019

(30) Foreign Application Priority Data

Jan. 14, 2016 (DE) ..... 10 2016 000 390.1

(51) Int. Cl.
*B05B 17/00* (2006.01)
*B05B 1/14* (2006.01)
(Continued)

(52) U.S. Cl.
CPC ..... *B05B 1/20* (2013.01); *B05B 1/14* (2013.01); *B05B 17/0638* (2013.01); *B05C 5/027* (2013.01); *B05C 5/0291* (2013.01)

(58) Field of Classification Search
CPC .. B05B 1/14; B05B 1/20; B05B 1/205; B05B 17/0638; B05B 17/0646; B05C 5/027; B05C 5/0291
(Continued)

(56) References Cited

U.S. PATENT DOCUMENTS 3,708,798 A 1/1973 Hildenbrand et al.
4,508,266 A 4/1985 Saito et al.
(Continued)

FOREIGN PATENT DOCUMENTS

CN 1176485 A 3/1998
CN 1242262 A 1/2000
(Continued)

OTHER PUBLICATIONS

Kyle Pucci; "What Causes Wetting?"; Aug. 3, 2018; Internet Article from Imageexpert.com; 5 pages (Year: 2018).*
(Continued)

*Primary Examiner* — Darren W Gorman
(74) *Attorney, Agent, or Firm* — Bejin Bieneman PLC

(57) ABSTRACT

A perforated plate for an application device for application of a fluid to a component, preferably a motor vehicle body and/or an attachment for this, comprises at least four through-holes for passage of the fluid. The through-holes are assigned to a nozzle row with a central region and two edge regions and are spaced apart from each other by hole spacings. The at least one outermost hole spacing of the nozzle row in at least one edge region is larger than at least
(Continued)

one hole spacing in the central region. An application device and an application method with such a perforated plate is also disclosed.

22 Claims, 14 Drawing Sheets

(51) Int. Cl.
*B05B 1/20* (2006.01)
*B05C 5/02* (2006.01)

(58) Field of Classification Search
USPC ..... 239/566
See application file for complete search history.

(56) References Cited

U.S. PATENT DOCUMENTS 4,622,239 A 11/1986 Schoenthaler et al.
4,792,817 A 12/1988 Barney
5,571,560 A 11/1996 Lin
5,602,572 A 2/1997 Rylander
5,699,491 A 12/1997 Barzel
5,769,946 A 6/1998 Kutsuzawa et al.
5,769,949 A 6/1998 Cienkus et al.
5,818,477 A 10/1998 Fullmer et al.
5,820,456 A 10/1998 Nelson
6,062,056 A * 5/2000 Groch ..... B21B 45/0218 72/201
6,096,132 A 8/2000 Kaiba et al.
6,106,107 A 8/2000 Sheinman
6,136,449 A 10/2000 Furuuchi et al.
6,247,657 B1 * 6/2001 Finney, Jr. ..... B05B 1/185 239/690.1
6,264,547 B1 7/2001 Waelti
6,302,523 B1 10/2001 Smith
6,325,490 B1 * 12/2001 Yang ..... B41J 2/1433 347/100
6,331,326 B1 12/2001 Tsunoda et al.
6,375,319 B1 4/2002 Kamano et al.
6,428,132 B1 8/2002 Kubatzki et al.
6,517,187 B1 2/2003 Dietl et al.
6,592,203 B1 7/2003 Bates et al.
6,764,162 B2 7/2004 Biddle et al.
7,182,815 B2 2/2007 Katagami et al.
7,625,065 B2 12/2009 Kanda
7,857,423 B2 * 12/2010 Suzuki ..... B41J 2/155 347/40
8,567,909 B2 10/2013 Sieber
9,085,151 B2 7/2015 Iriguchi
2002/0155069 A1 10/2002 Pruche
2002/0166232 A1 11/2002 Fujita et al.
2002/0175962 A1 11/2002 Otsuki
2003/0029379 A1 2/2003 Onogawa et al.
2003/0048314 A1 3/2003 Renn
2003/0155451 A1 8/2003 Hisashi et al.
2003/0159651 A1 8/2003 Sakurada
2003/0186613 A1 10/2003 Kawase
2003/0202215 A1 10/2003 Biddle et al.
2004/0165021 A1 8/2004 Desie
2005/0048897 A1 3/2005 Tong
2005/0156960 A1 7/2005 Courian et al.
2005/0179724 A1 8/2005 Salt et al.
2005/0189442 A1 * 9/2005 Hussaini ..... B05B 1/202 239/556
2006/0044376 A1 3/2006 Baird et al.
2006/0068109 A1 3/2006 Frankenberger et al.
2006/0103691 A1 5/2006 Dietl et al.
2006/0171250 A1 8/2006 Frosztega et al.
2006/0197723 A1 9/2006 Sikora et al.
2007/0034715 A1 2/2007 Clifford
2007/0062383 A1 3/2007 Gazeau et al.
2007/0076069 A1 4/2007 Edwards et al.
2007/0097176 A1 5/2007 Hickey et al.
2007/0146399 A1 * 6/2007 Yamamoto ..... B41J 2/06 347/9
2008/0047486 A1 2/2008 Herre et al.
2008/0236484 A1 10/2008 Herre et al.
2008/0252671 A1 10/2008 Cannell et al.
2008/0311836 A1 12/2008 Bhattacharya
2009/0002441 A1 1/2009 Yoshiro et al.
2009/0057445 A1 3/2009 Hung
2009/0284570 A1 11/2009 Jung et al.
2010/0047465 A1 2/2010 Ansorge et al.
2010/0051071 A1 3/2010 Calhoun et al.
2010/0079543 A1 4/2010 Otokita
2010/0231644 A1 * 9/2010 Otokita ..... B41J 19/142 347/37
2011/0052819 A1 3/2011 Ebisawa
2011/0262622 A1 10/2011 Herre et al.
2013/0222454 A1 8/2013 Iriguchi
2015/0211461 A1 7/2015 Shirk
2015/0375241 A1 12/2015 Wohr et al.

FOREIGN PATENT DOCUMENTS

CN 1651898 A 8/2005
CN 1668386 A 9/2005
CN 102021753 A 4/2011
CN 102294317 A 12/2011
CN 103402726 A 11/2013
CN 104040276 A 9/2014
CN 104994963 A 10/2015
DE 1887910 U 2/1964
DE 3130096 A1 5/1982
DE 3140486 A1 5/1982
DE 3927880 A1 1/1991
DE 4204704 A1 8/1993
DE 4238378 A1 5/1994
DE 29614871 U1 12/1996
DE 19734485 A1 2/1998
DE 19731829 A1 1/1999
DE 19852079 A1 5/2000
DE 29724351 U1 12/2000
DE 102004044655 A1 3/2006
DE 102006005341 A1 8/2007
DE 60218929 T2 12/2007
DE 102006032804 A1 1/2008
DE 102006047382 A1 4/2008
DE 102006060398 A1 6/2008
DE 202011001109 U1 3/2011
DE 10 2010 019 612 A1 11/2011
DE 102011056823 A1 6/2013
DE 10 2013 002 413 A1 8/2014
EP 0026359 A2 4/1981
EP 0206452 A2 12/1986
EP 0538147 A2 4/1993
EP 0970811 A1 1/2000
EP 1065055 A1 1/2001
EP 1095707 A2 5/2001
EP 1253626 A2 10/2002
EP 1277579 A2 1/2003
EP 1449667 A1 8/2004
EP 1884365 A1 2/2008
EP 2208541 A2 7/2010
FR 2514267 A1 4/1983
FR 2862563 A1 5/2005
GB 2107614 A 5/1983
GB 2177946 A 2/1987
JP S53-126930 A 11/1978
JP S5625465 A 3/1981
JP H03151073 A 6/1991
JP 04063163 A 2/1992
JP H06121944 A 5/1994
JP H0679506 U 11/1994
JP H0737797 A 2/1995
JP H08274014 A 10/1996
JP H09075825 A 3/1997
JP 0994527 A 4/1997
JP H09164706 A 6/1997
JP H10083982 A 3/1998
JP H10197967 A 7/1998
JP 11076889 A 3/1999

(56) References Cited

FOREIGN PATENT DOCUMENTS

| | | | |
|---|---|---|---|
| JP | 2000033289 | A | 2/2000 |
| JP | 2000135459 | A | 5/2000 |
| JP | 2000238254 | A | 9/2000 |
| JP | 2002096474 | A | 4/2002 |
| JP | 2003103791 | A | 4/2003 |
| JP | 2003117460 | A | 4/2003 |
| JP | 2003144991 | A | 5/2003 |
| JP | 2003165226 | A | 6/2003 |
| JP | 2003-329828 | A | 11/2003 |
| JP | 2004066081 | A | 3/2004 |
| JP | 2005028227 | A | 2/2005 |
| JP | 2005-088548 | A | 4/2005 |
| JP | 2005254210 | A | 9/2005 |
| JP | 2006-289239 | A | 10/2006 |
| JP | 2007154431 | A | 6/2007 |
| JP | 2008-246713 | A | 10/2008 |
| JP | 201040323 | A | 2/2010 |
| JP | 2010076362 | A | 4/2010 |
| JP | 2011049002 | A | 3/2011 |
| JP | 2011526832 | A | 10/2011 |
| JP | 2011230410 | A | 11/2011 |
| JP | 2013180437 | A | 9/2013 |
| JP | 2014502920 | A | 2/2014 |
| JP | 2015506412 | A | 3/2015 |
| JP | 2016513003 | A | 5/2016 |
| JP | 5976320 | B2 | 8/2016 |
| JP | 2016175077 | A | 10/2016 |
| JP | 6130950 | B2 | 5/2017 |
| WO | 88/08755 | A1 | 11/1988 |
| WO | 9632282 | A1 | 10/1996 |
| WO | 98/28088 | A2 | 7/1998 |
| WO | 01/15812 | A1 | 3/2001 |
| WO | 2007131636 | A1 | 11/2007 |
| WO | 2008125967 | A2 | 10/2008 |
| WO | 2008128019 | A1 | 10/2008 |
| WO | 2010146473 | A1 | 12/2010 |
| WO | 2014121926 | A1 | 8/2014 |

OTHER PUBLICATIONS

European Examination Report for EP17700769.7 dated Jul. 22, 2020 (3 pages; English translation not available).
Article: New Sprayers Make Car Body Painting More Economical, 2004; 4 pages (inlcuding abstract).
International Search Report for PCT/EP2009/007448, dated Jan. 29, 2010.
"Types of Residential Plumbing Systems". Oct. 8, 1999. Web. Sep. 2, 2014; <<http://www.chilipperapp.com/ps.htm>>.
Obst, Manfred "Lackierereien planen und optimieren", Moderne Lackiertechnik, p. 41, 2002, ISBN: 3878707371.
EPO Office Action dated Feb. 7, 2018 for Application No. EP16 001 687.9 (4 pages).
SIPO Office Action dated Feb. 1, 2018 for Application No. CN20161044566.2 (7 pages; with English translation).
SIPO Office Action dated Dec. 14, 2017 for Application No. 201610445627.7 (6 pages; with English translation).
EPO Office Action for EP 17700769.7-1010 dated Nov. 19, 2019 (3 pages).
International Search Report and Written Opinion for PCT/EP2017/000038 dated Mar. 24, 2017 (16 pages; with English translations).
International Search Report and Written Opinion for PCT/EP2017/000037 dated Apr. 21, 2017 (16 pages; with English translations).
Non-Final Office Action for U.S. Appl. No. 15/911,580 dated Jun. 28, 2019 (11 pages).
Non-Final Office Action for U.S. Appl. No. 16/069,926 dated Mar. 27, 2020 (45 pages).
Chinese Office Action for Application No. CN201780013202.1 dated Mar. 30, 2020 (8 pages).
Notification of Reasons for Rejection from the Japanese Patent Office for JP2018536725 received Sep. 15, 2020 (8 pages).
Notification of Reasons for Rejection from the Japanese Patent Office for JP2018536731 received Sep. 15, 2020 (9 pages).
China National Intellectual Property Administration Search Report for CN 201780013200.2 dated Mar. 30, 2020 (2 pages; English translation only).
Final Office Action for U.S. Appl. No. 16/069,926 dated Sep. 2, 2020 (24 pages).
Non-Final Office Action dated Mar. 22, 2021 for U.S. Appl. No. 16/069,926 (27 pages).

* cited by examiner

PERFORATED PLATE WITH INCREASED HOLE SPACING IN ONE OR BOTH EDGE REGIONS OF A ROW OF NOZZLES

CROSS-REFERENCE TO RELATED APPLICATIONS

This application is a national stage of, and claims priority to, Patent Cooperation Treaty Application No. PCT/EP2017/000038, filed on Jan. 13, 2017, which application claims priority to German Application No. DE 10 2016 000 390.1, filed on Jan. 14, 2016, which applications are hereby incorporated herein by reference in their entireties.

BACKGROUND

The disclosure concerns a perforated plate (e.g. cover) for an application device (e.g. applicator) for application of a fluid to a component, in particular a motor vehicle body and/or an attachment for this. The disclosure furthermore concerns an application device and an application method in which such a perforated plate is used.

DE 10 2013 002 413 A1 discloses a perforated plate for an applicator for application of a coating medium in particular without overspray. The perforated plate here comprises several through-holes for application of the coating medium, wherein the through-holes are arranged in several nozzle rows in a matrix pattern and hence in a two-dimensional configuration. In this way, sharp-edged coating medium tracks can be produced. The disadvantage however is that the sharp-edged coating tracks are unsuitable for overlapping since they have an at least approximately rectangular cross-sectional profile. FIG. 13 shows for example an almost perfect joint between two coating medium tracks B1* and B2* with a rectangular cross-sectional profile. Such a perfect joint should have a variance of +/−50 μm, which would lead to the optimum coating shown on the right in FIG. 13. Such a perfect joint is not possible in practice, or only possible at substantial cost, for example because of tolerances. FIG. 14 shows two coating medium tracks B1* and B2* with rectangular cross-sectional profile, which do not touch or overlap in the joint/overlap region, which leads to a disadvantageous indentation in the resulting coating, as shown on the right in FIG. 14. FIG. 15 shows two coating medium tracks B1* and B2* with rectangular cross-sectional profile which overlap in the joint/overlap region so that an over-coating occurs, which leads to a disadvantageous peak or protrusion in the resulting coating, as shown on the right in FIG. 15.

DE 10 2010 019 612 A1 discloses an application device which provides a cross-sectional profile in the form of a trapezium, which is more suitable for overlapping of coating tracks. The trapezoid profile is produced by several through-holes for application of the coating medium, wherein the through-holes are arranged in several nozzle rows in a matrix pattern and hence in a two-dimensional configuration. Differently sized nozzle diameters, distributed regularly or superficially, serve in particular to achieve a better resolution with a superficial coating. The two-dimensional configuration with nozzle diameters of the same or different sizes, and the resulting trapezoid profile, firstly have a high complexity because of the plurality of through-holes. In addition, the two-dimensional configuration gives an undesirably high flow of coating medium, in particular when the coating medium is applied continuously as is usual when painting vehicle bodywork. The two-dimensional configuration also means that, on application of a coating track, coating medium from a nozzle row arranged downstream relative to the movement direction is applied on top of coating medium from a nozzle row arranged upstream in the movement direction, which disadvantageously can lead to coating medium splashes because coating medium is applied onto coating medium which has not yet dried or set sufficiently. U.S. Pat. No. 5,769,946 A may also be cited as the general prior art.

DETAILED DESCRIPTION

Figure 1:
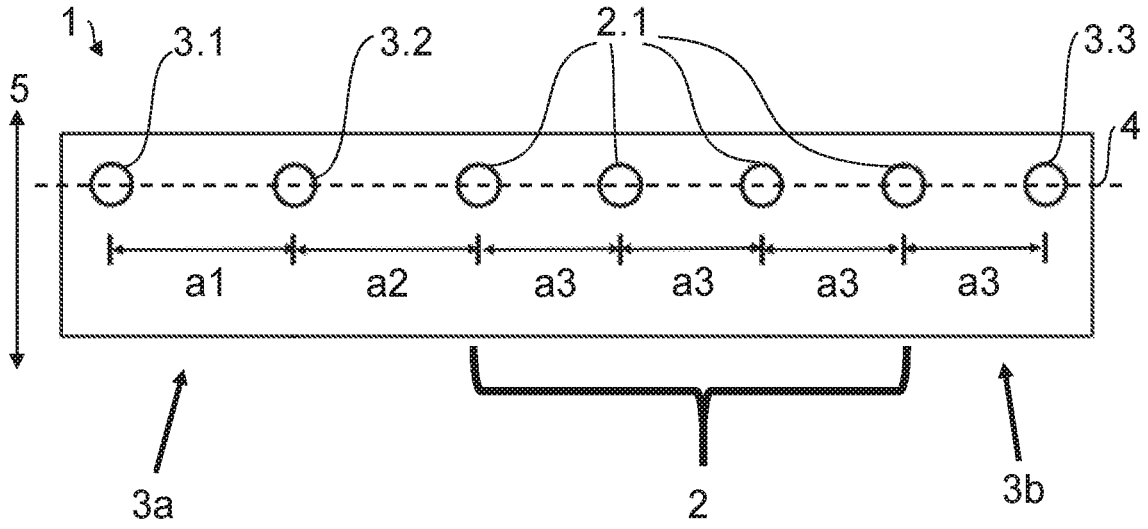
FIG. 1 shows a perforated plate with a nozzle row according to one example of the disclosure.

The disclosure provides an improved and/or alternative perforated plate, in particular a perforated plate which allows an improved joint or overlap region of two fluid tracks and/or a fluid application which is at least substantially free from fluid splashes.

The disclosure provides a perforated plate (e.g. cover, strip, chip etc.) for an application device (e.g. an applicator) for application of a fluid to a component, in particular a motor vehicle body and/or an attachment for this.

The perforated plate and/or the application device serves in particular for application of the fluid without atomisation and/or masking.

The fluid may e.g. be a coating medium, in particular a paint, a sealant, a separating agent, a function layer or an adhesive.

The fluid preferably has a viscosity of more than 50 mPas, more than 80 mPas or even more than 100 mPas, in particular measured with a shear rate of 1000 $s^{-1}$. The fluid may have a Newtonian or non-Newtonian flow behaviour.

The perforated plate preferably has at least four or at least five through-holes for passage of the fluid. The through-holes are suitably arranged in a nozzle row preferably oriented substantially linearly, wherein the nozzle row comprises two edge regions and a central region suitably extending between the two edge regions. The through-holes may in particular be spaced apart from each other by hole spacings.

The perforated plate is distinguished in particular in that the at least one outermost hole spacing of the nozzle row in at least one edge region is greater than at least one hole spacing in the central region, so that preferably a fluid application (e.g. fluid track) with a substantially trapezoid cross-sectional profile is possible, e.g. a substantially rectangular, isosceles or non-isosceles trapezoid cross-sectional profile, and/or a cross-sectional profile with a substantially Gaussian curve shape.

The at least one outermost hole spacing in particular corresponds to the first hole spacing of the nozzle row from the outside in the at least one edge region.

The at least two, at least three and/or at least four outermost hole spacings correspond in particular to the two, three and/or four first hole spacings of the nozzle row from the outside in the at least one edge region.

The stepping, and hence suitable increase in hole spacing, may apply only to the outermost and hence to the first hole spacing from the outside in just one edge region or in both edge regions.

The stepping, and hence suitable increase in hole spacing, may also however apply to the at least two, at least three and/or at least four outermost hole spacings, and hence at least two, at least three and/or at least four of the first hole spacings from the outside, in just one edge region or in both edge regions.

In the case of an increase in hole spacing in just one edge region, preferably a fluid application (e.g. fluid track) may be produced with substantially rectangular trapezoid cross-sectional profile.

In the case of an increase in hole spacing in both edge regions, preferably a fluid application (e.g. fluid track) is produced with substantially isosceles or non-isosceles trapezoid cross-sectional profile.

In particular, the disclosure allows an improved distribution of layer thickness in the joint or overlap region of two fluid applications (e.g. fluid tracks), which leads to visually uniform fluid surfaces (e.g. coating surfaces), suitably without fluctuations in layer thickness which would disadvantageously be perceptible to the human eye. Alternatively or additionally, the disclosure allows in particular that, by application of the fluid from preferably just a single nozzle row and hence in a one-dimensional nozzle configuration, application splashes are reduced or fully avoided because the nozzle row applies the fluid directly to the component, in some cases with the exception of a possible joint or overlap region of two fluid applications, wherein in the joint or overlap region the previously applied fluid has however usually already dried or hardened sufficiently and hence no longer has a tendency—or at least has only a greatly reduced tendency—to form fluid splashes.

By means of the perforated plate according to the disclosure, a spacing tolerance between two suitably sharp-edged fluid applications (e.g. fluid tracks) can be achieved of up to +/−150 μm, +/−200 μm, +/−500 μm, +/−1 mm or even +/−2 mm.

It is possible that the perforated plate has only one single nozzle row for application of the fluid, so that a one-dimensional nozzle configuration is possible.

It is possible that the nozzle row is oriented centred linearly and/or the centre axes of preferably all through-holes of the nozzle row are oriented linearly, e.g. along one and the same alignment line (suitably a straight alignment line).

It is possible that all through-holes of the nozzle row are configured uniformly (e.g. substantially identically).

The outermost hole spacing of the nozzle row in at least one edge region may suitably have the largest hole spacing of the nozzle row.

The at least two outermost hole spacings of the nozzle row in at least one edge region may be larger than at least one hole spacing in the central region.

The at least two outermost hole spacings in at least one edge region may e.g. be formed uniformly (suitably substantially the same size) or non-uniformly (suitably different sizes).

The centre region may comprise at least two, at least three or at least four hole spacings, and hence suitably at least three, at least four or at least five through-holes.

The at least one edge region may e.g. comprise at least two or at least three hole spacings.

It is possible that the hole spacings in the central region are configured uniformly (suitably substantially the same size) so that the through-holes in the central region are spaced evenly from each other. Alternatively or additionally, the through-holes in the central region may suitably be formed uniformly.

It is possible that the outermost hole spacing in the one edge region of the nozzle row is formed uniformly (e.g. substantially the same) or non-uniformly (e.g. differently) relative to the outermost hole spacing in the other edge region.

It is also possible that the at least two outermost hole spacings in the one edge region of the nozzle row are formed uniformly (e.g. substantially the same) or non-uniformly (e.g. differently) relative to the at least two outermost hole spacings in the other edge region.

The at least one outermost hole spacing in the one edge region may e.g. be larger than at least one hole spacing in the central region, and the at least one outermost hole spacing in other edge region may be formed uniformly (e.g. substantially the same size) relative to the at least one hole spacing in the central region.

Preferably, all through-holes of the nozzle row may each have a hole inlet opening on the upstream side of the perforated plate, and a hole outlet opening on the downstream side of the perforated plate, and e.g. a pipe stub as a three-dimensional structuring on the downstream side of the perforated plate.

The hole inlet openings may e.g. have a larger passage cross-section than the hole outlet openings, and/or the pipe stubs may suitably have an outer casing surface which tapers towards the free end of the respective pipe stub, in particular conically.

The two edge regions may be formed for example symmetrically or asymmetrically. Preferably, the nozzle row as a whole is formed symmetrically, in particular axially symmetrically and or mirror symmetrically, relative to an axis of symmetry running transversely to the nozzle row.

It is possible that the outermost hole spacing in at least one edge region is larger by at most a factor of 2 or 3 than a respective hole spacing in the central region.

It is possible that the at least two outermost hole spacings of the nozzle row in at least one edge region are each larger by at most a factor 2 or 3 than a respective hole spacing in the central region.

It is possible that all through-holes of the nozzle row are formed uniformly (suitably substantially identically), in particular have the same passage cross-section.

It is possible that at least one through-hole in the central region of the nozzle row and/or at least one through-hole in at least one edge region of the nozzle row has a hopper-shaped hole inlet opening and a cylindrical hole outlet opening. The hopper-shaped hole inlet opening may taper in the flow direction of the fluid.

The hopper-shaped hole inlet opening of the at least one through-hole in the central region may e.g. extend more deeply into the perforated plate than the hopper-shaped hole inlet opening of the at least one through-hole in the at least one edge region. Alternatively or additionally, an inlet cross-section (e.g. the inlet-side passage cross-section) of a hole inlet opening of at least one through-hole in the central region of the nozzle row may be larger than an inlet cross-section (e.g. the inlet-side passage cross-section) of a hole inlet opening of at least one through-hole in at least one edge region of the nozzle row.

The nozzle row may in particular be configured to form a fluid application (e.g. fluid track) with a substantially trapezoid cross-sectional profile, e.g. a substantially rectangular, isosceles or non-isosceles trapezoid cross-sectional profile and/or a cross-sectional profile with substantially Gaussian curve shape, so that the nozzle row is suitable in particular for producing fluid tracks which are optimized for overlap.

In one example, the hole inlet openings of the through-holes of the nozzle row have a larger passage cross-section than the hole outlet openings.

The disclosure is not restricted to a perforated plate but also comprises an application device, e.g. an applicator for application of a fluid, wherein the application device has at least one perforated plate as disclosed herein.

It is possible that the application device is configured to ensure a fluid inflow with equal pressure over the entire nozzle row, and hence suitably over all through-holes.

It is also possible that the application device is configured to guarantee a fluid inflow in the at least one edge region which can be controlled (e.g. regulated) independently of the central region.

The two edge regions may e.g. be supplied with fluid by the same fluid delivery unit or each have their own fluid delivery unit, so that in particular each edge region can be supplied with fluid via a separately controllable (e.g. regulatable) fluid delivery unit.

The application device serves preferably for application of a fluid with a viscosity of over 50 mPas, over 80 mPas or over 100 mPas, in particular at a shear rate of 1000 $s^{-1}$. The fluid may have a Newtonian or a non-Newtonian flow behaviour.

It is possible that the application device has at least two perforated plates arranged next to each other, the nozzle rows of which are preferably arranged offset to each other in the longitudinal direction of the nozzle rows.

The at least one perforated plate may in particular be arranged at (e.g. on or in) an outer end face of the application device, and thus preferably constitute an outer plate. The at least four through-holes consequently preferably form outlet holes from the application device.

The disclosure furthermore includes an application method for application of a fluid by means of at least one application device and/or at least one perforated plate as disclosed herein.

In particular, it is possible that the fluid is applied from one single nozzle row of the perforated plate.

It should be mentioned that the fluid may be a coating medium, e.g. a paint, a sealant, a separating agent, an adhesive etc., and/or may serve to form a function layer.

The category of function layer includes in particular layers which lead to a surface functionalisation, such as e.g. adhesion-promoting agents, primers or layers to reduce transmission.

In the context of the disclosure, it is possible to supplement the perforated plate as described herein with features from WO 2014/121926 A1, in particular its claims, so that the full content of this patent application is to be included to the present disclosure.

The perforated plate according to the disclosure may in particular have hole inlet openings on the upstream side of the perforated plate and hole outlet openings on the downstream side of the perforated plate, and e.g. three-dimensional structurings on the upstream side of the perforated plate and/or on the downstream side of the perforated plate.

It is possible that the hole inlet openings are fluidically optimised, in particular nozzle-shaped, and/or that the hole inlet openings have a larger (passage) cross-section than the hole outlet openings.

It is possible that pipe stubs serve as structurings, which protrude from the downstream side of the perforated plate and into which the through-holes transform, in order in particular to reduce the wetting surface area at the hole outlet openings.

The pipe stubs may e.g. have an outer casing surface which tapers, in particular conically, towards the free end of the respective pipe stub.

The perforated plate may e.g. have a greater thickness at the edge than in a central region with the through-holes.

It is possible that preferably all through-holes in the perforated plate are produced at least partially by an etching production method, in particular dry etching or wet etching.

The perforated plate may in particular consist at least partially of a semiconductor material, e.g. one of the following materials: silicon, silicon dioxide, silicon carbide, gallium, gallium arsenide and/or indium phosphide.

It should be mentioned that, in the context of the disclosure, the feature of a substantially trapezoid cross-sectional profile may preferably comprise also e.g. a cross-sectional profile with substantially Gaussian curve shape.

The embodiments described with reference to the figures partially correlate, so the same reference signs are used for similar or identical parts and for their explanation, in order to avoid repetition, reference is made to the description of one or more other embodiments.

FIG. 1 shows a perforated plate 1 for an application device for application of a fluid, which may be without atomisation and masking, to a component, e.g. a motor vehicle body and/or an attachment for this.

The perforated plate 1 includes seven through-holes 2.1, 3.1, 3.2 and 3.3 for passage of the fluid, wherein the through-holes 2.1, 3.1, 3.2 and 3.3 are assigned to one nozzle row with a central region 2 and two edge regions 3*a* and 3*b*, and are spaced apart from each other by hole spacings a1, a2 and a3.

The nozzle row comprises in particular a central region 2 with four through-holes 2.1, a first edge region 3*a* (on the left in FIG. 1) with two through-holes 3.1 and 3.2, and a second edge region 3*b* (on the right in FIG. 1) with one through-hole 3.3.

The first edge region 3*a* comprises two outermost hole spacings a1 and a2. The second edge region 3*b* comprises one outermost hole spacing a3.

The two outermost hole spacings a1 and a2 in the edge region 3*a* are larger than the hole spacings a3 in the central region.

The through-holes 2.1 in the central region 2 are evenly spaced apart from each other by equal-sized hole spacings a3.

The outermost hole spacing a3 in the edge region 3*b* is formed uniformly with the hole spacings a3 in the central region 2.

The two outermost hole spacings a1 and a2 in the edge region 3*a* may suitably be formed uniformly (a1=a2) or non-uniformly (a1≠a2).

The perforated plate 1 has only one single nozzle row, wherein the nozzle row is aligned linearly centred along a straight alignment line 4, so that the centre axes of preferably all through-holes 2.1, 3.1, 3.2 and 3.3 of the nozzle row are aligned linearly along one and the same alignment line 4.

The through-holes 2.1, 3.1, 3.2 and 3.3 of the nozzle row are preferably uniform and hence formed substantially identically.

The double arrow 5 marks the two possible movement directions of the perforated plate 1 relative to the component.

Figure 2:
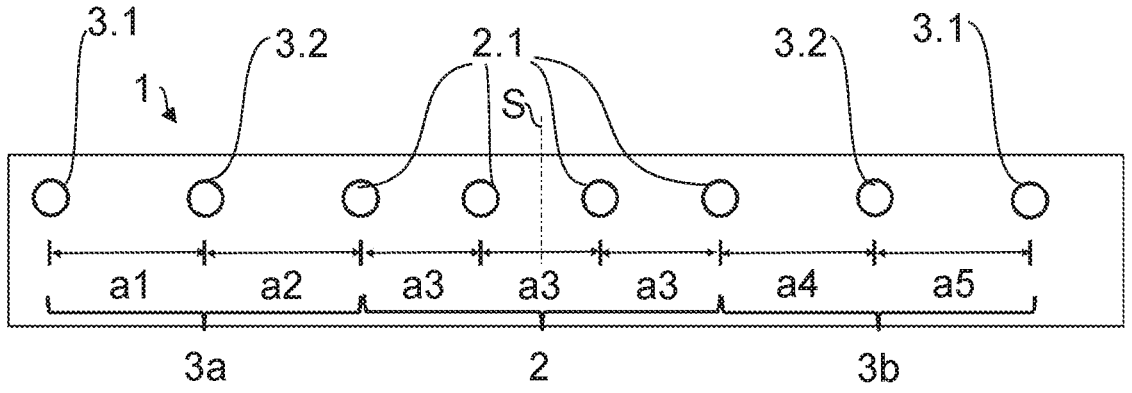
FIG. 2 shows a perforated plate with a nozzle row according to another example of the disclosure.

FIG. 2 shows a perforated plate 1 according to another example of the disclosure.

In the perforated plate 1 shown in FIG. 2, the stepping, and hence the increase in hole spacing, takes place in both edge regions 3*a* and 3*b*.

Thus the through-holes 3.1 and 3.2 of the first edge region 3*a* may be spaced apart from each other by hole spacings a1 and a2, and the through-holes 3.1 and 3.2 of the second edge region 3*b* may be spaced apart from each other by hole spacings a4 and a5.

The hole spacings a1, a2, a4 and a5 are all larger than the uniform hole spacings a3 in the central region 2.

The two outermost hole spacings a1 and a2 in the edge region 3*a* may be formed uniformly or non-uniformly relative to the two outermost hole spacings a4 and a5 in the edge region 3*b* (a1=a5; a1≠a5; a2=a4; a2≠a4).

In the example shown in FIG. 2, in contrast to FIG. 1, the nozzle row as a whole may be formed symmetrically, in particular axially symmetrically and or mirror symmetrically relative to an axis of symmetry S running transversely to the nozzle row.

Figure 3:
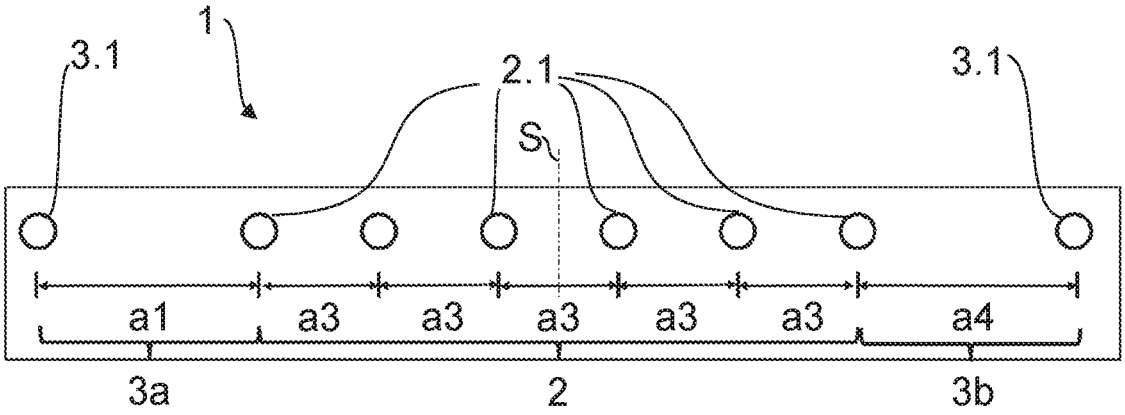
FIG. 3 shows a perforated plate with a nozzle row according to yet another example of the disclosure.

FIG. 3 shows a perforated plate 1 according to yet another example of the disclosure.

In the perforated plate 1 shown in FIG. 3, the increase in hole spacing takes place in both edge regions 3*a* and 3*b*. The two edge regions 3*a* and 3*b* here do not however each comprise two hole spacings (as in FIG. 2), but only one hole spacing a1 and a4 respectively.

The outermost hole spacing a1 in the edge region 3*a* may here be formed uniformly or non-uniformly relative to the outermost hole spacing a4 in the edge region 3*b* (a1=a4; a1≠a4).

Figure 4:
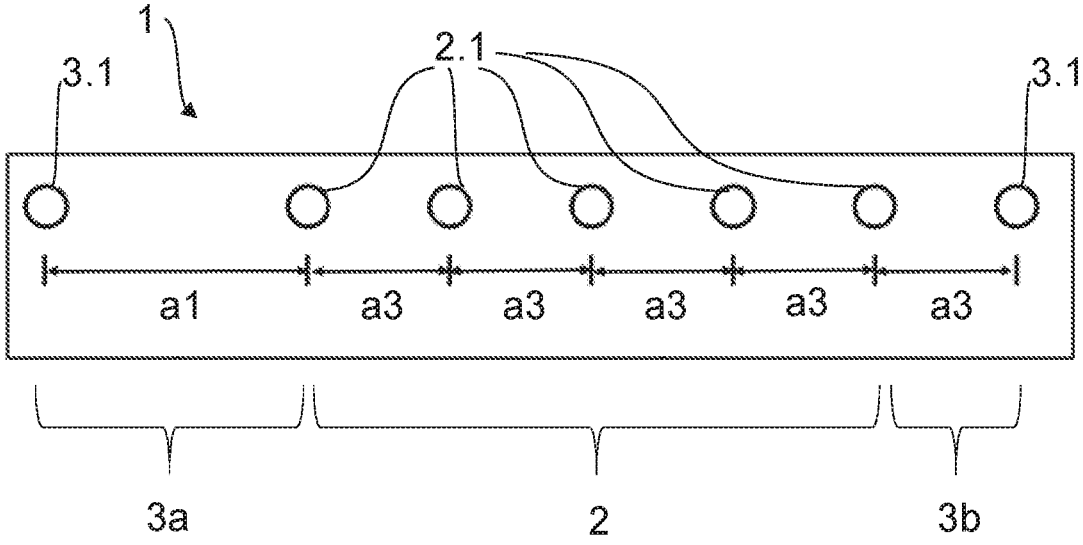
FIG. 4 shows a perforated plate with a nozzle row according to yet another example of the disclosure.

FIG. 4 shows a perforated plate 1 according to yet another example of the disclosure.

In the perforated plate 1 shown in FIG. 4, only the outermost hole spacing a1 of the nozzle row in the edge region 3*a* is larger than the uniform hole spacings a3 in the central region 2.

The outermost hole spacing a3 in the edge region 3*b* is configured uniformly to the hole spacings a3 in the central region 2.

Figure 5A:
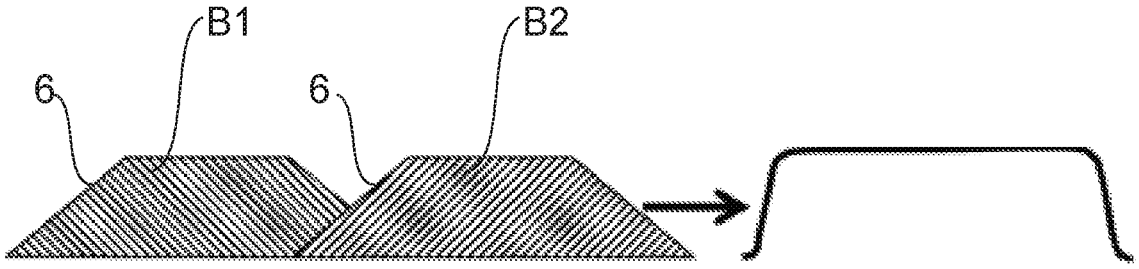
FIG. 5A shows a schematic cross-sectional depiction of two fluid applications produced by a perforated plate according to the disclosure, in one example of the disclosure.

FIG. 5A shows a schematic depiction of the cross-section through two fluid tracks B1 and B2 which may be produced by means of a perforated plate 1 according to one example of the disclosure.

The cross-sections of the coating medium tracks B1 and B2 have a substantially isosceles trapezoid form 6 and overlap in a joint or overlap region. The spacing tolerances between the two fluid tracks B1 and B2 may lie in the range of +/−150 μm, +/−200 μm, +/−500 μm, +/−1 mm or even +/−2 mm. The trapezoid form 6 leads to an optimum coating, shown on the right in FIG. 5A, in particular in the overlap region.

Figure 5B:
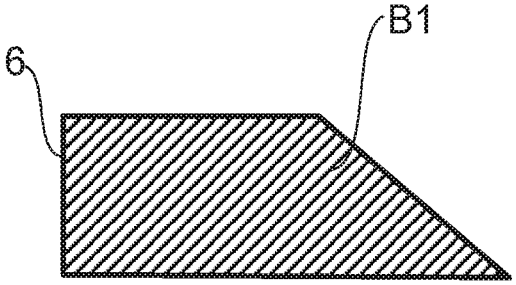
FIG. 5B shows a schematic cross-sectional depiction of a fluid application produced by a perforated plate according to the disclosure, in one example of the disclosure.

FIG. 5B shows a schematic depiction of the cross-section of a fluid track B1 which may be produced by means of a perforated plate 1 according to one example of the disclosure. The cross-section has a substantially rectangular trapezoid form 6.

The perforated plate 1 according to FIGS. 1 to 4 serves suitably for use with an application device for application of a fluid. The application device may be configured to guarantee an inflow of fluid with substantially equal pressure over the entire nozzle row.

However, the application device may also be configured to allow a fluid inflow in the at least one edge region 3*a* or 3*b* which can be controlled (e.g. regulated) independently of the central region 2.

The two edge regions 3*a* and 3*b* may be supplied with fluid e.g. via the same fluid delivery unit or each by its own fluid delivery unit.

FIGS. 6 to 11 illustrate through-hole formations according to various examples of the disclosure, with possible configurations of the respective through-holes 2.1, 3.1, 3.2 and 3.3 of the nozzle row. The perforated plate 1 and in particular the through-holes may here be configured as disclosed in WO 2014/121926 A1, so the full content of this patent application is to be included in the present disclosure.

Figure 6:
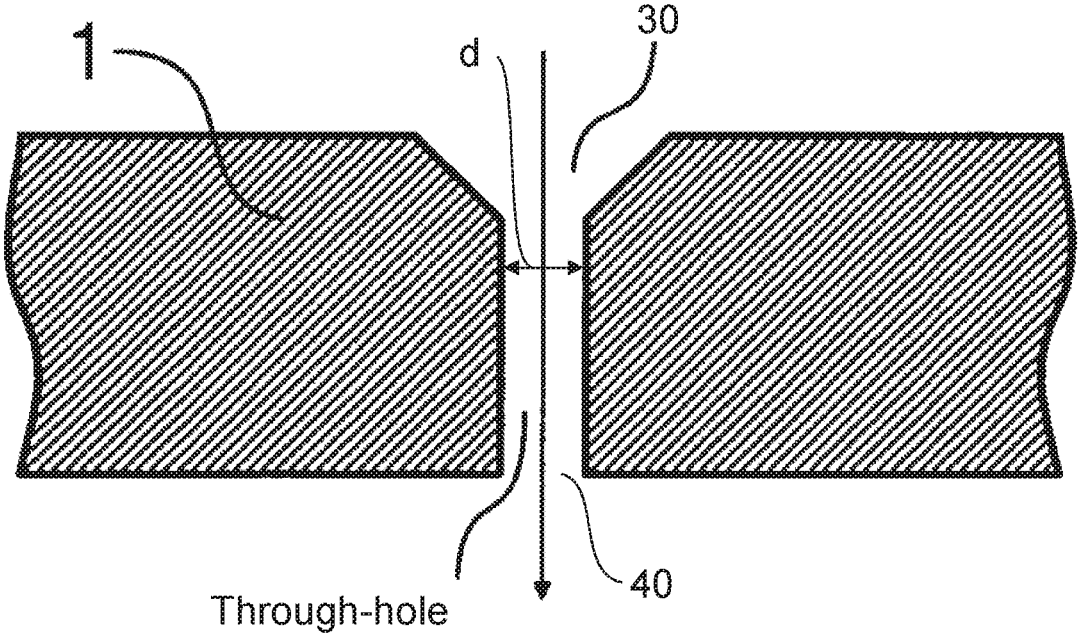
FIG. 6 shows a cross-sectional view through a through-hole of a perforated plate according to one example of the disclosure.

FIG. 6 shows a cross-sectional view through a perforated plate 1 in the region of one of the through-holes, wherein the arrow in the cross-sectional view indicates the flow direction of the coating medium through the through-hole. It is evident from the cross-sectional view that the through-hole has a hole inlet opening 30 which is fluidically optimised, by means of which the flow resistance of the through-hole is reduced.

In addition, the perforated plate 1 has a structuring on the downstream side, on the peripheral edge of each through-hole, which reduces the wetting tendency.

Figure 7A:
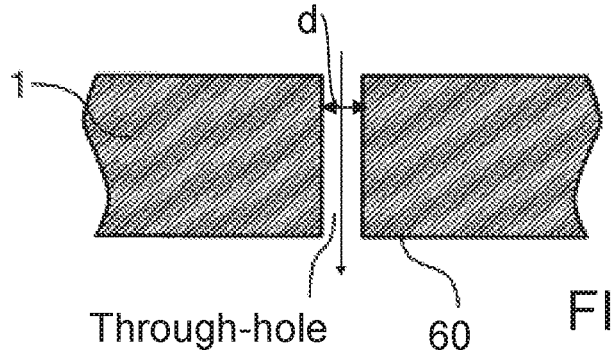
FIG. 7A shows a cross-sectional view through a through-hole of a perforated plate in another variant, according to one example of the disclosure.
Figure 7B:
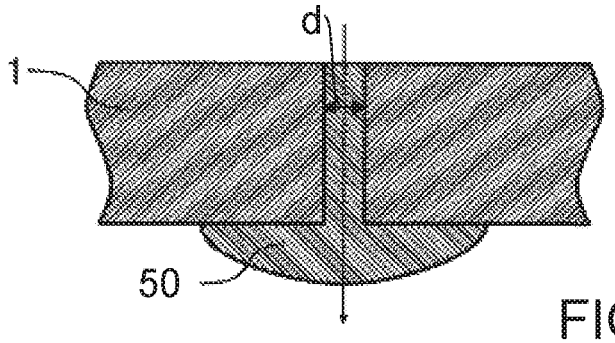
FIG. 7B shows a cross-sectional view from FIG. 7A with coating medium in the through-hole.

FIGS. 7A and 7B show an alternative cross-sectional view through the perforated plate 1 in the region of a through-hole, wherein FIG. 7A shows the through-hole without coating medium, while FIG. 7B shows a coating medium (e.g. fluid) 50.

It is evident from this that the coating medium 50 wets a wetting surface 60 on the downstream surface of the perforated plate 1, which impedes a jet-shaped release of the coating medium 50 from the perforated plate 1.

Figure 8A:
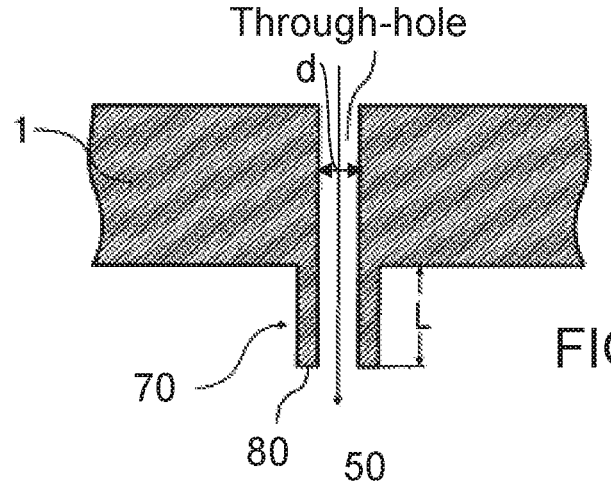
FIG. 8A shows a derivative of FIG. 7A with an additional pipe stub to reduce the wetting surface area, according to another example of the disclosure.
Figure 8B:
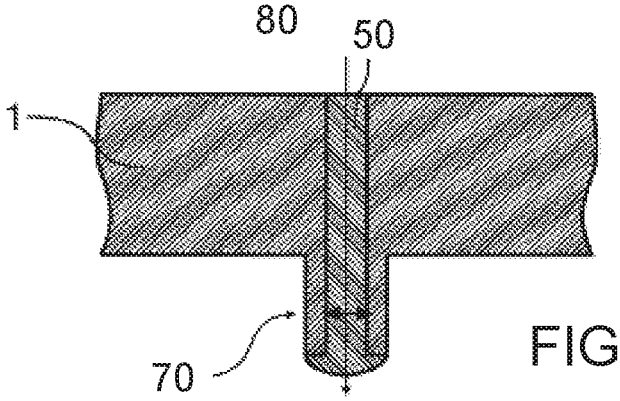
FIG. 8B shows the cross-sectional view from FIG. 8A with coating medium in the through-hole.

FIGS. 8A and 8B show an example of the disclosure with a reduced wetting tendency. For this, the perforated plate 1 has a pipe stub 70 on the peripheral edge of each individual through-hole, wherein the through-hole transitions into the pipe stub 70 so that at the free end of the pipe stub 70, the end face of the pipe stub 70 forms a wetting surface 80. The wetting surface 80 is thus restricted to the free end face of the pipe stub 70 and hence substantially smaller than the wetting surface 60 in FIG. 7A. This facilitates the release of the coating medium 50 from the perforated plate 1.

Between the downstream side of the perforated plate 1 and the free end of the pipe stub 70, the pipe stub 70 has for example a length L which is preferably greater than 50 μm, 70 μm, or 100 μm and/or less than 200 μm, 170 μm or 150 μm, so that the pipe stub 70 may have e.g. a length L of between 50 to 200 μm, 70 to 170 μm or 100 to 150 μm.

Figure 9:
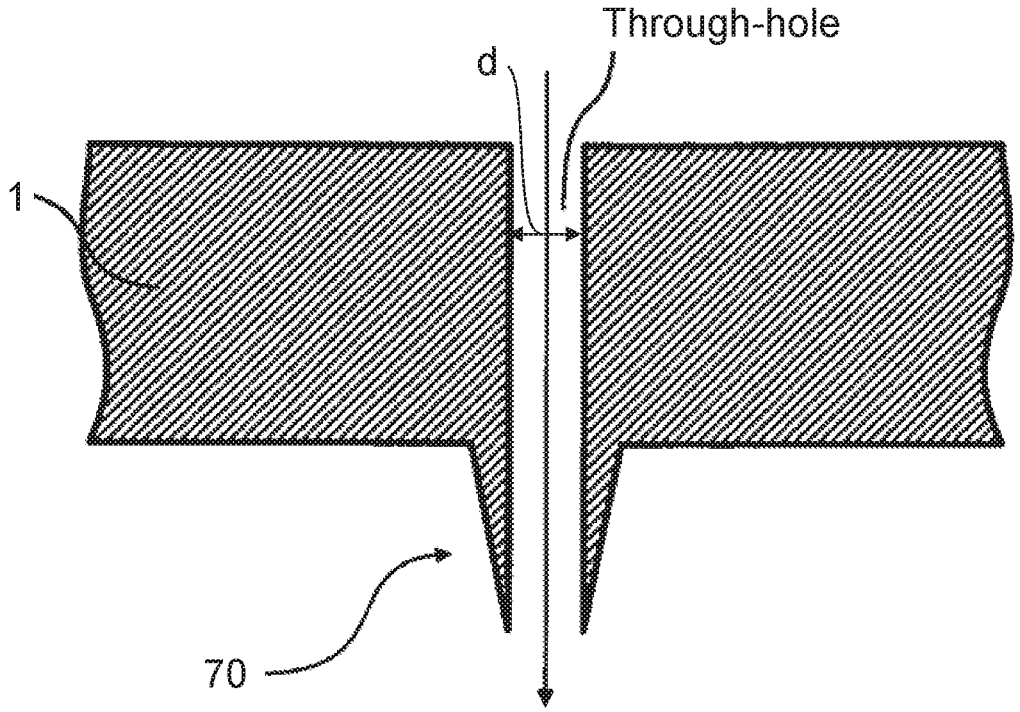
FIG. 9 shows a derivative of FIG. 8A with a conically tapering pipe stub according to another example of the disclosure.

FIG. 9 shows a derivative of FIG. 8A, wherein the outer casing surface of the pipe stub 70 tapers conically towards the free end of the pipe stub 70, so that the wetting surface at the free end of the pipe stub 70 is minimal.

Figure 10A:
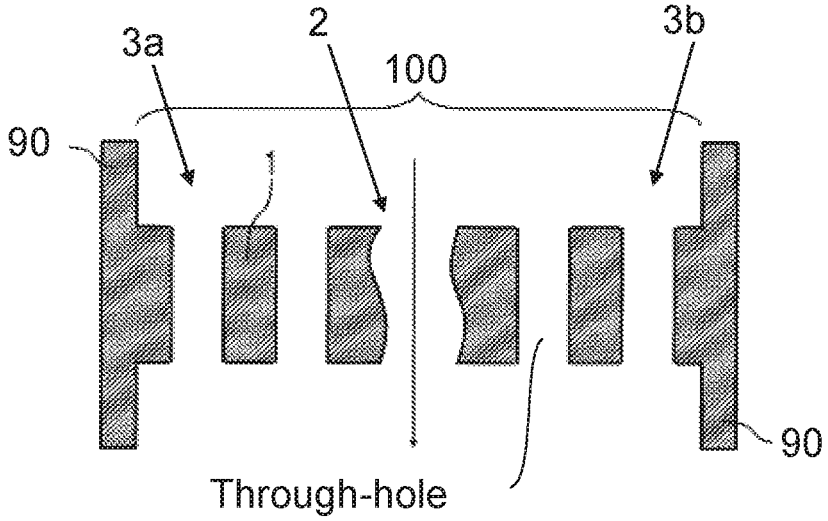
FIG. 10A shows a schematic cross-sectional view through a perforated plate with a reinforced edge and a thinner central region with the through-holes according to another example of the disclosure.

FIG. 10A shows a schematic cross-sectional view through a perforated plate 1 which partially correlates with the perforated plates described above, so to avoid repetition, reference is made to the description above, wherein the same reference signs are used for corresponding details.

One feature of this example is that the perforated plate 1 has a relatively thick edge 90 on the outside, and a thinner region 100 with the through-holes in the middle. The thick edge 90 of the perforated plate 1 here ensures adequate mechanical stability, while the reduction in thickness in the region 100 with the through-holes ensures that the through-holes offer only a relatively low flow resistance.

Figure 10B:
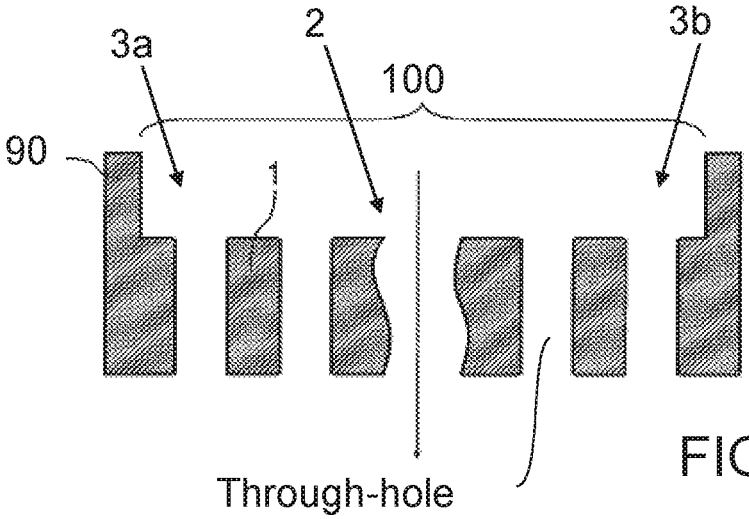
FIG. 10B shows a derivative of FIG. 10A according to another example of the disclosure.

FIG. 10B shows a derivative of FIG. 10A, so to avoid repetition, reference is made to the description of FIG. 10A, wherein the same reference signs are used for corresponding details.

A particular feature of this example is that the region 100 is here reduced in thickness on one side only.

The sharp edges and corners shown in the figures are depicted merely as examples and may advantageously also be rounded in order to configure them fluidically optimised or to achieve better rinsability.

Figure 11:
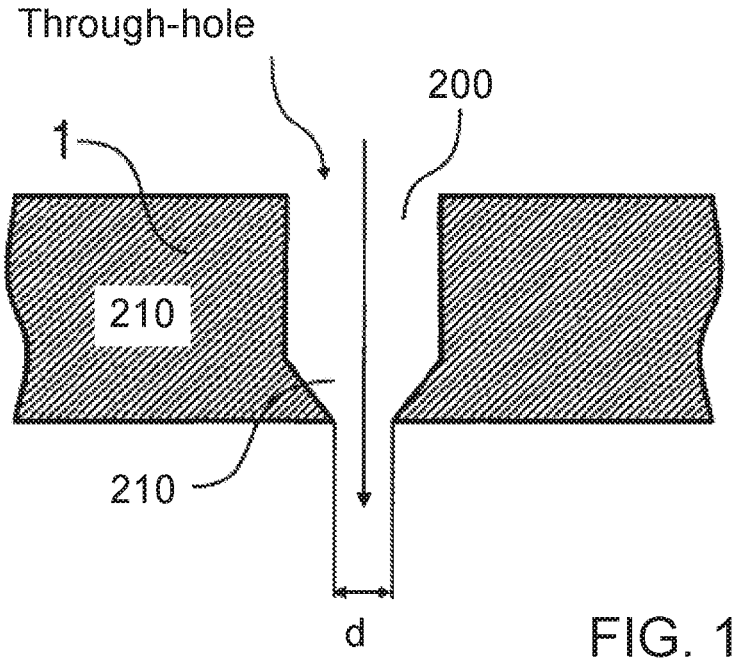
FIG. 11 shows a derivative of FIG. 6 according to another example of the disclosure.

A particular feature of the example of the through-hole shown in FIG. 11 is that at the upstream hole inlet opening, the through-hole firstly has a cylindrical region 200 with a first inner diameter.

Then, in the flow direction, the cylindrical region 200 is followed by a conical region 210 which tapers in the flow direction.

It is important here that the inner diameter d of the hole outlet opening is preferably substantially smaller than the inner diameter of the cylindrical region 200.

Figure 12A:
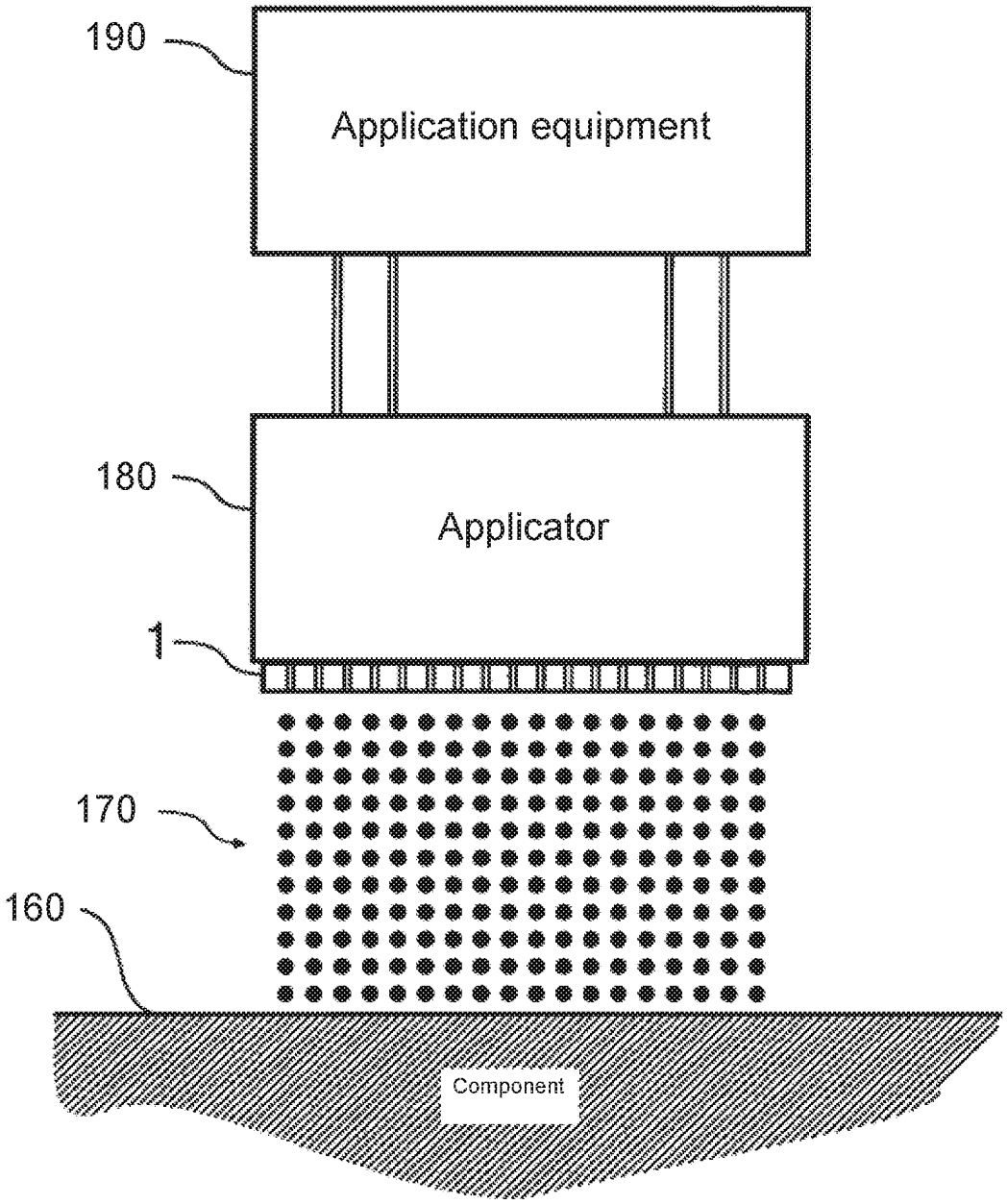
FIG. 12A shows an application device (applicator) with a perforated plate according to another example of the disclosure.

FIG. 12A shows in highly simplified schematic depiction an application device, in particular an applicator, with a perforated plate 1 according to the disclosure for coating a component 160 (e.g. a motor vehicle body component).

Jets 170 of coating medium here emerge from the individual through-holes of the perforated plate 1 and form a cohesive film of coating medium on the surface of the component 160. The individual jets 170 of coating medium may be formed as droplet jets as shown in FIG. 12A, or as cohesive jets of coating medium, in particular without forming droplets, as shown in FIG. 12B.

Figure 12B:
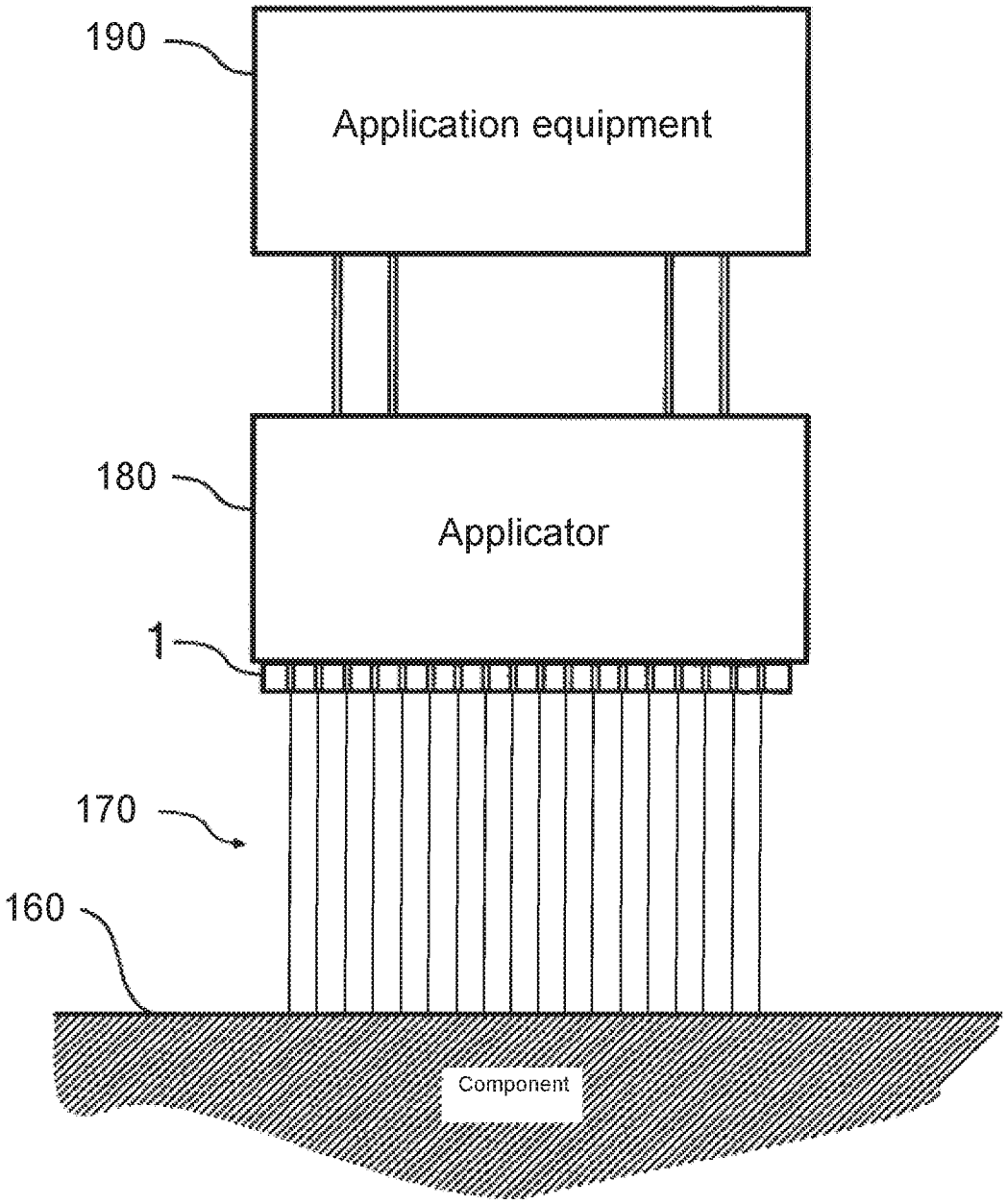
FIG. 12B shows an application device (applicator) according to another example of the disclosure.
Figure 13:
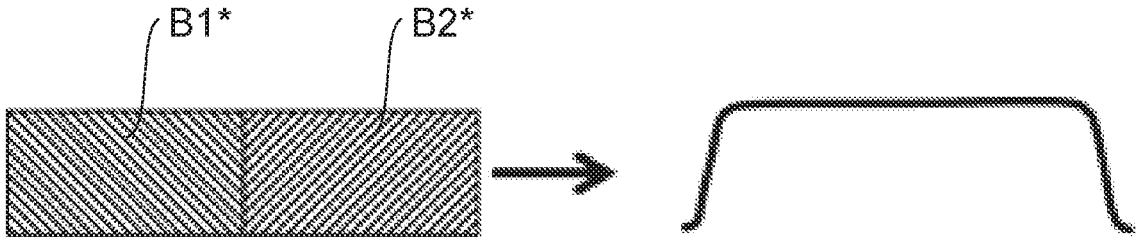
Prior art FIG. 13
FIG. 13 shows two coating medium tracks according to the prior art.
Figure 14:
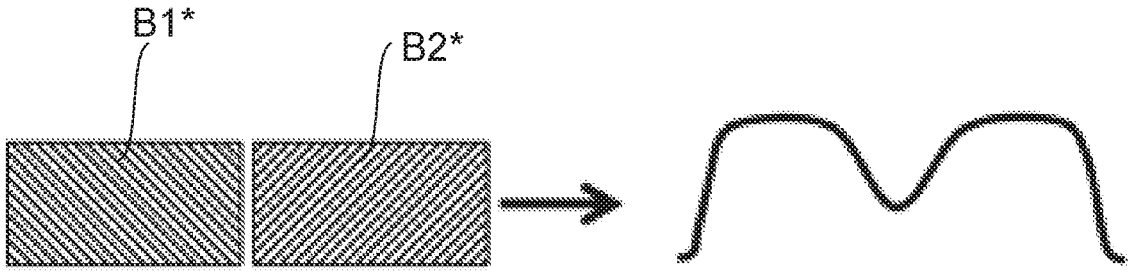
Prior art FIG. 14
FIG. 14 shows two coating medium tracks according to the prior art.
Figure 15:
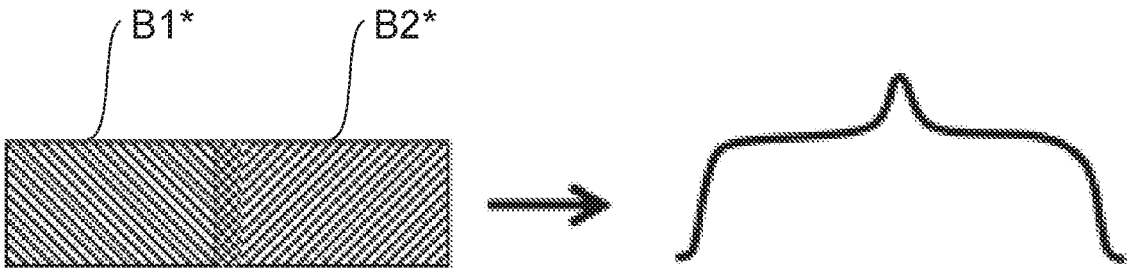
Prior art FIG. 15
FIG. 15 shows two coating medium tracks according to the prior art.

Furthermore, FIGS. 12A and 12B show an applicator 180 connected to the perforated plate 1, and an application equipment 190 which is connected to the applicator 180 by schematically depicted lines.

FIGS. 12A and 12B also show that the perforated plate 1 is arranged on an outer end face of the application device, so that the through-holes of the perforated plate 1 form outlet holes from the application device.

Figure 16:
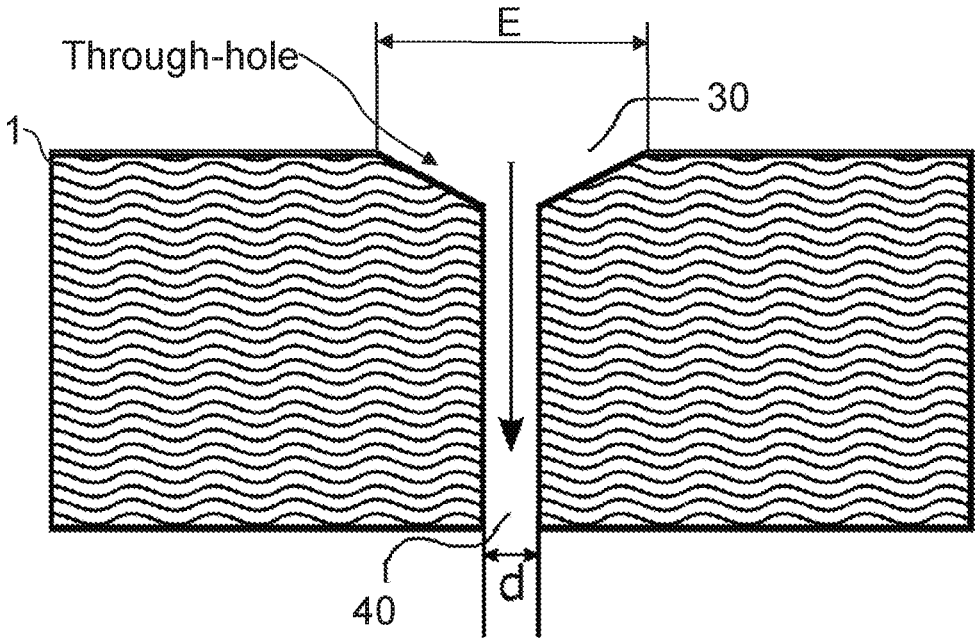
FIG. 16 shows a cross-sectional view through a through-hole of the perforated plate according to one example of the disclosure.

FIG. 16 shows a cross-sectional view through a through-hole of a perforated plate 1 according to one example of the disclosure. The through-hole comprises a hopper-shaped hole inlet opening 30 with an inlet cross-section E and a cylindrical hole outlet opening 40.

Figure 17:
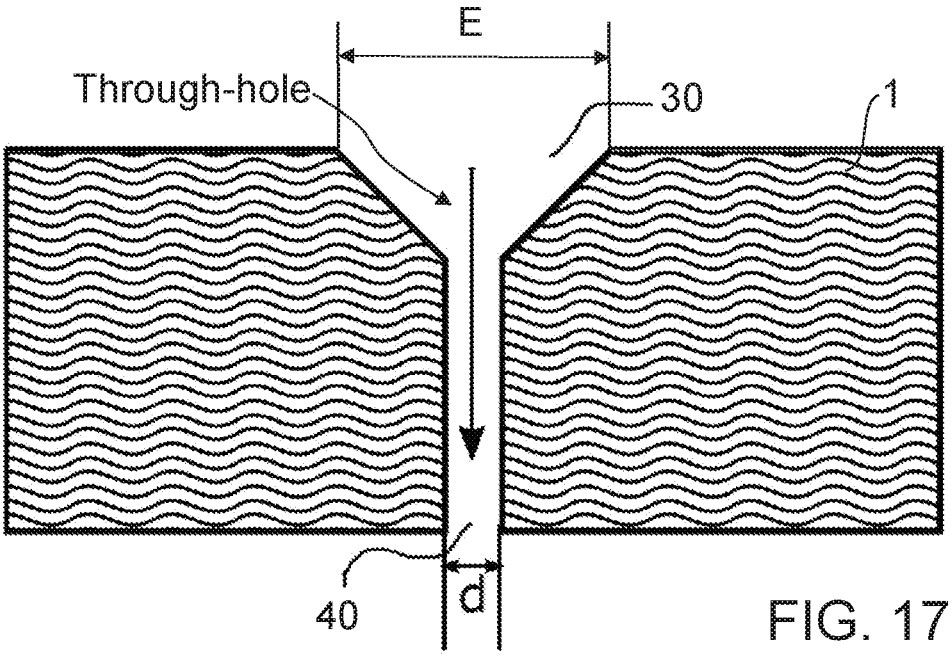
FIG. 17 shows a cross-sectional view through a through-hole of a perforated plate according to another example of the disclosure.

FIG. 17 shows a cross-sectional view through a through-hole of a perforated plate 1 according to another example of the disclosure. The through-hole comprises a hopper-shaped hole inlet opening 30 with an inlet cross-section E and a cylindrical hole outlet opening 40, wherein the hopper-shaped hole inlet opening 30 of FIG. 17 extends more deeply into the perforated plate 1 than the hopper-shaped hole inlet opening 30 of FIG. 16.

Figure 18:
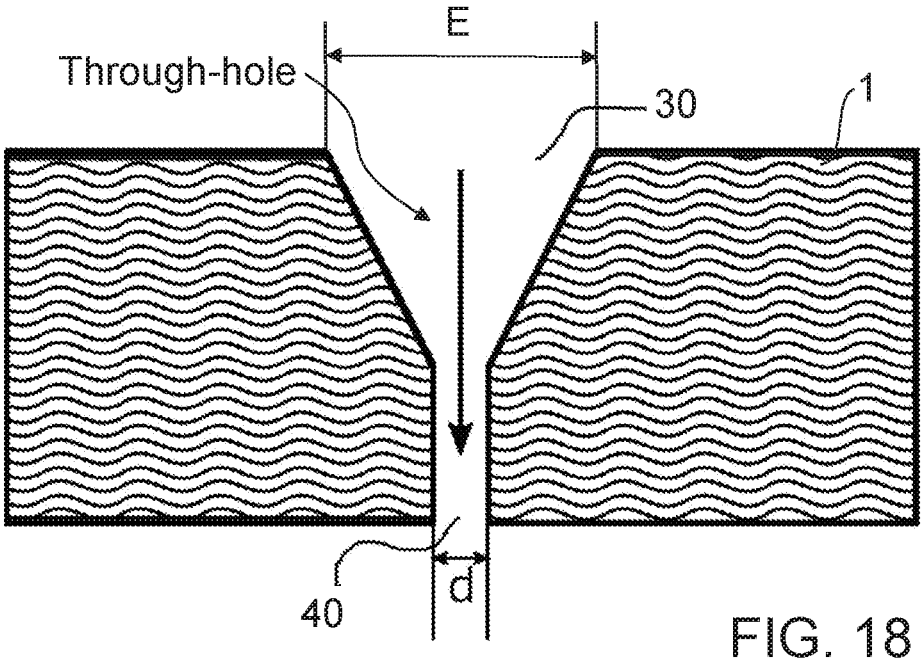
FIG. 18 shows a cross-sectional view through a through-hole of a perforated plate according to yet another example of the disclosure.

FIG. 18 shows a cross-sectional view through a through-hole of a perforated plate 1 according to another example of the disclosure. The through-hole comprises a hopper-shaped hole inlet opening 30 with an inlet cross-section E and a cylindrical hole outlet opening 40, wherein the hopper-shaped inlet opening 30 in FIG. 18 extends more deeply into the perforated plate 1 than the hopper-shaped hole inlet opening 30 in FIG. 17.

Figure 19:
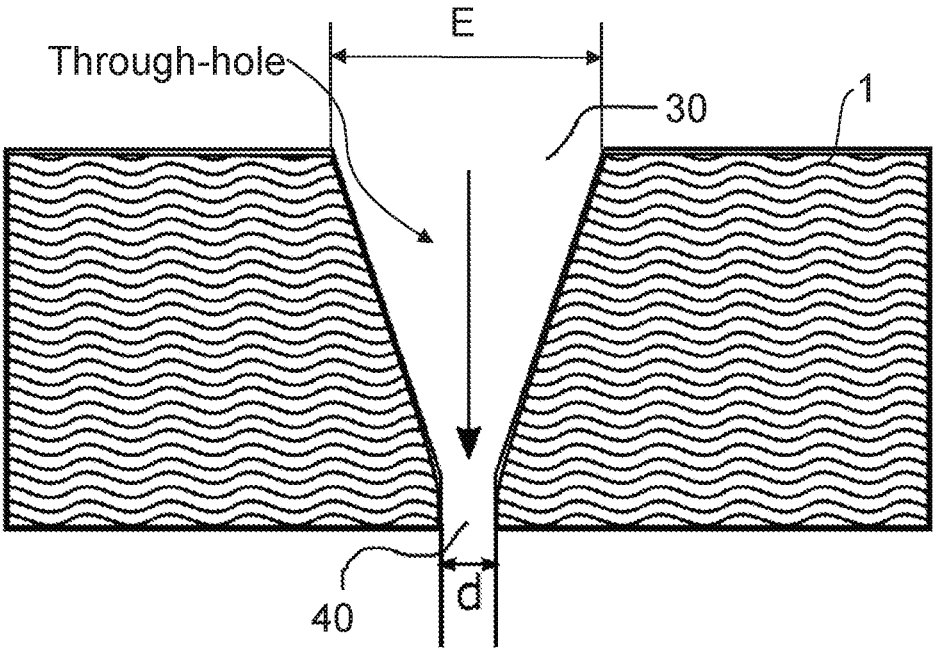
FIG. 19 shows a cross-sectional view through a through-hole of a perforated plate according to a further example of the disclosure.

FIG. 19 shows a cross-sectional view through a through-hole of a perforated plate 1 according to another example of the disclosure. The through-hole comprises a hopper-shaped hole inlet opening 30 with an inlet cross-section E and a cylindrical hole outlet opening 40, wherein the hopper-shaped inlet opening 30 in FIG. 19 extends more deeply into the perforated plate 1 than the hopper-shaped hole inlet opening 30 in FIG. 18.

FIGS. 16 to 19 in particular show an additional possibility for influencing the fluid flow by changing the cylindrical proportion of a through-hole, in that its hole inlet opening 30 is configured hopper-shaped. By providing a hopper-shaped hole inlet opening 30 so that the cylindrical proportion of the through-hole can be reduced or enlarged, the fluid volume flow through the through-hole may be increased or reduced further, although for example in FIGS. 16 to 19 the (reference) opening diameters d and the inlet cross-sections E are the same size. FIG. 16 here allows the smallest, FIG. 17 the second smallest, FIG. 18 the third smallest and FIG. 19 the largest fluid volume flow.

The through-holes shown in FIGS. 16 to 19 may suitably be used in the central region 2 of the nozzle row and/or in at least one edge region 3*a*, 3*b* of the nozzle row.

It must also be mentioned that an application device according to one example of the disclosure may comprise at least two perforated plates 1 arranged next to each other, the nozzle rows of which are arranged offset to each other in the longitudinal direction of the nozzle rows. The perforated plates 1 here are arranged on an outer end face of the application device so they constitute outer plates.

The invention claimed is:

1. An apparatus, comprising:

a perforated plate for an application device for application of a fluid onto a component, the perforated plate having a plurality of through-holes for passage of the fluid; and a pipe stub as a three-dimensional structuring at each of the plurality of through-holes and on a downstream side of the perforated plate;

wherein the plurality of through-holes are assigned to a nozzle row with a central region and two edge regions and spaced apart from each other by hole spacings;

wherein at least one outermost hole spacing of the nozzle row in at least one edge region of the two edge regions is larger than at least one hole spacing in the central region; and wherein the at least one outermost hole spacing in the at least one edge region of the two edge regions of the nozzle row is formed non-uniformly relative to another outermost hole spacing in the other edge region of the two edge regions of the nozzle row.

2. The apparatus according to claim 1, wherein the perforated plate has only one single nozzle row for application of the fluid.

3. The apparatus according to claim 1, wherein the nozzle row is aligned centred linearly.

4. The apparatus according to claim 1, wherein the centre axes of all through-holes of the nozzle row are aligned linearly.

5. The apparatus according to claim 1, wherein all through-holes of the nozzle row are formed uniformly.

6. The apparatus according to claim 1, wherein the at least one outermost hole spacing of the nozzle row has a largest hole spacing of the nozzle row.

7. The apparatus according to claim 1, wherein at least two outermost hole spacings of the nozzle row in at least one edge region of the two edge regions are larger than at least one hole spacing in the central region.

8. The apparatus according to claim 1, wherein at least two outermost hole spacings of the nozzle row in at least one edge region of the two edge regions are formed one of uniformly and non-uniformly.

9. The apparatus according to claim 1, wherein hole spacings in the central region are formed uniformly so that through-holes of the plurality of through-holes in the central region are spaced evenly apart.

10. The apparatus according to claim 1, wherein all through-holes in the central region are formed uniformly.

11. The apparatus according to claim 1, wherein at least two outermost hole spacings in the at least one edge region of the two edge regions of the nozzle row are formed non-uniformly relative to at least two outermost hole spacings in the other edge region of the two edge regions of the nozzle row.

12. The apparatus according to claim 1, wherein the at least one outermost hole spacing in the other edge region is formed uniformly relative to the at least one hole spacing in the central region.

13. The apparatus according to claim 1, wherein the nozzle row is configured to form a fluid application with a substantially trapezoid cross-sectional profile.

14. The apparatus according to claim 1 wherein the through-holes of the nozzle row each have a hole inlet opening on the upstream side of the perforated plate and a hole outlet opening on the downstream side of the perforated plate, wherein the hole inlet openings have a larger passage cross-section than the hole outlet openings.

15. The apparatus according to claim 14, wherein the pipe stubs have an outer casing surface which tapers towards a free end of the respective pipe stub.

16. The apparatus according to claim 1, wherein the at least one outermost hole spacing is larger than a hole spacing in the central region by at most a factor of 3.

17. The apparatus according to claim 1, wherein at least two outermost hole spacings of the nozzle row in the at least one edge region are each larger than a hole spacing in the central region by at most a factor of 3.

18. The apparatus according to claim 1, wherein one of: at least one through-hole in the central region of the nozzle row and at least one through-hole in at least one edge region of the two edge regions of the nozzle row has a hopper-shaped hole inlet opening.

19. The apparatus according to claim 18, wherein the at least one through-hole having a hopper-shaped hole inlet opening has a cylindrical hole outlet opening.

20. The apparatus according to claim 18, wherein both of the at least one through-hole in the central region and the at least one through-hole in the at least one edge region have the hopper-shaped hole inlet opening, and wherein the hopper-shaped hole inlet opening of the at least one through-hole in the central region extends more deeply into the perforated plate than the hopper-shaped hole opening of the at least one through-hole in the at least one edge region.

21. The apparatus according to claim 1, wherein an inlet cross-section of a hole inlet opening of at least one through-hole in the central region of the nozzle row is larger than an inlet cross-section of a hole inlet opening of at least one through-hole in at least one edge region of the two edge regions of the nozzle row.

22. An apparatus, comprising:

a perforated plate for an application device for application of a fluid onto a component, the perforated plate having a plurality of through-holes for passage of the fluid; and a pipe stub as a three-dimensional structuring at each of the plurality of through-holes and on a downstream side of the perforated plate;

wherein the plurality of through-holes are assigned to a nozzle row with a central region and two edge regions and spaced apart from each other by hole spacings;

wherein at least one outermost hole spacing of the nozzle row in at least one edge region of the two edge regions is larger than at least one hole spacing in the central region; and wherein at least two outermost hole spacings in the at least one edge region of the two edge regions of the nozzle row are formed non-uniformly relative to at least two outermost hole spacings in the other edge region of the two edge regions of the nozzle row.

* * * * *